US006293057B1

(12) United States Patent
Amos Hays

(10) Patent No.: US 6,293,057 B1
(45) Date of Patent: Sep. 25, 2001

(54) LIGHTWEIGHT PRE-ENGINEERED PREFABRICATED MODULAR BUILDING SYSTEM

(76) Inventor: Gary David Amos Hays, 5220 S. 24th St., Fort Smith, AR (US) 72901

( * ) Notice: Subject to any disclaimer, the term of this patent is extended or adjusted under 35 U.S.C. 154(b) by 0 days.

(21) Appl. No.: 09/441,345

(22) Filed: Nov. 16, 1999

Related U.S. Application Data

(63) Continuation-in-part of application No. 08/802,815, filed on Feb. 19, 1997, now Pat. No. 5,983,577.

(51) Int. Cl.[7] ..... E04C 3/08

(52) U.S. Cl. ..... 52/79.1; 52/92.2; 52/92.3; 52/639; 52/643; 52/653.1; 52/653.2; 52/655.1; 52/691; 52/693

(58) Field of Search ..... 52/92.2, 92.3, 52/93.1, 639, 643, 653.1, 653.2, 655.1, 691, 693, 79.1

(56) References Cited

U.S. PATENT DOCUMENTS 2,713,924 * 7/1955 Tripp ..... 52/93.1 X
2,764,107 * 9/1956 Niswonger et al. ..... 52/643
3,157,251 * 11/1964 Rasch ..... 52/643
3,928,951 * 12/1975 Murphy ..... 52/92.2
4,201,021 * 5/1980 Aldag et al. ..... 52/639 X
4,854,104 * 8/1989 Pomento ..... 52/639
5,983,577 * 11/1999 Hays ..... 52/79.1
6,006,485 * 12/1999 Hobbs et al. ..... 52/93.1 X
6,052,953 * 4/2000 Jewell ..... 52/639 X

* cited by examiner

*Primary Examiner*—Christopher T. Kent
(74) *Attorney, Agent, or Firm*—Jerry L. Mahurin

(57) ABSTRACT

A Lightweight Pre-engineered prefabricated modular Building System comprised of prefabricated structural members and three prefabricated spacer plates which create the entire building main frame system. A multiple use principal structural member is utilized as top and bottom cords as well as end rungs for trusses and truss legs. The spacer plates are used to construct steep pitch building frames. Trusses are interchangeable anywhere in system. Eave peak members, purlins and girts are used to attach sheathing to the structural frame.

17 Claims, 8 Drawing Sheets

LIGHTWEIGHT PRE-ENGINEERED PREFABRICATED MODULAR BUILDING SYSTEM

CROSS REFERENCE TO RELATED PATENT APPLICATION

This is a Continuation-In-Part of U.S. patent application Ser. No. 08/802,815, Filed Feb. 19, 1997, which issued on Nov. 16, 1999 as U.S. Pat. No. 5,983,577.

BACKGROUND OF THE INVENTION

1. Technical Field

The present invention broadly relates to a building system. Specifically the present invention is a light weight pre-engineered prefabricated modular building system. Art pertinent to the subject matter of the present invention can be found in various Subclasses of United States Patent Class 52.

2. The Prior Art

Numerable patents have been issued on modular building systems and components used in such systems. For example, many patents have been issued on building trusses. Pomento, U.S. Pat. No. 4,854,104, discloses a wooden truss member intended to connect a column and roof beam. Sheppard, U.S. Pat. No. 4,616,453, discloses a light gauge steel building system and truss design. Wilbanks, U.S. Pat. No. 4,312,160, discloses a truss assembly employing criss-crossed struts extending from a column to a mid point of an opposite rafter. Wormser, U.S. Pat. No. 3,462,895, discloses a symmetrical shelter truss commonly used for pavilions and the like. Davenport, U.S. Pat. No. 4,435,940 discloses a metal building truss employing top and bottom cords made of channel iron material. Funk, U.S. Pat. No. Des. 297,864, discloses a bolt together truss assembly employing channel iron members. Dividoff, U.S. Pat. No. 4,748,784, discloses a triangulated roof truss structure.

Many building systems employ specialized brackets for establishing joints between standardized, dimensional structural members. Brackets formed from sheet metal are popular for joining dimensional lumber. Such brackets are disclosed in Gilb, U.S. Pat. No. 5,372,448 and Southerland, U.S. Pat. No. 4,335,555. Two patents issued to Fritz, U.S. Pat. Nos. 4,901,496 and 4,930,268 disclose building brackets. The former is a two piece roof peak bracket and the latter a two piece post to roof beam bracket. Andrews, U.S. Pat. No. 4,773,192, discloses brackets used to connect structural members with interlocking or indexing shapes. Dufour, U.S. Pat. No. 4,974,387, discloses a prefabricated joint used to join steel trusses and dimensional steel members. McElhoe, U.S. Pat. No. 4,041,659 discloses a metal building structure employing tabs and brackets for securing structural steel members. Hale, U.S. Pat. No. 4,809,480 discloses a set of brackets used to join rafters, at the peak, to the columns and the columns to a supporting surface. Solo, U.S. Pat. No. 4,381,635, discloses a truss support system using a hinged or pivoted connector. Brown, U.S. Pat. No. 3,717,964 discloses a modular building frame system employing indexing tabs and stops to facilitate assembly. Matticks, U.S. Pat. No. 5,293,725 discloses a building comprised of interlocking components which employs few fasteners. Reid, U.S. Pat. No. 4,049,082, discloses a structural frame member. Geraci, U.S. Pat. No. 3,674,589, discloses a trihedrial clip and a variety of uses for the clip in steel frame construction.

The building industry has striven to provide a readily customizable building design. For example, Dean, U.S. Pat. No. 5,465,487, discloses a method for forming a rigid frame for construction.

The present Inventor previously developed a lightweight steel building system that utilized square steel tubing and five-sided ductile iron connectors. These connectors allow tubular structural members to attach from needed directions to create buildings in various sizes and configurations. A company founded by the present Inventor, Erecta Shelters, Inc. of Greenwood, Ark., has sold, designed, manufactured, and erected thousands of buildings using this tubing and ductile iron connector design.

The greatest demand for general purpose buildings is for sizes of fifteen to fifty feet in width, with eight to fourteen foot side wall heights, and lengths from twenty four to sixty feet. A large majority of these buildings are erected by the people who purchase them, not professional builders. This "Do It Yourself" trend is constantly increasing. The "Do It Yourself" portion of the building industry is undoubtedly the fastest growing part of the industry.

There are over one hundred steel building manufacturers in the United States; and customarily, lead time to fabricate a building is five to eight weeks. No manufacturer presently offers a pre-engineered prefabricated building available on the same day that the building is ordered.

SUMMARY OF THE INVENTION

My light weight pre-engineered prefabricated modular building system allows construction of a building employing easily inventoried selectively used spacer plates, structural members, and components capable of producing multiple gable wall heights, widths and configurations. Roof designs include double pitch, cantilever, and single pitch. Building lengths are independent from the gable, wall and roof design chosen. This novel modular building system, emphasizes simplicity of erection, longevity of product, insurability, customer service, affordability, mass production and mass distribution. Buildings built using the present system are insurable at a lower rate than conventional wooden or wood-masonry structures.

The modular system is comprised of pre-fabricated structural members and three selectively used spacer plates which create the entire building main frame system. By choosing to not use a spacer one selects a shallow roof pitch such as a two in fifteen ratio. If a spacer is used a steep roof pitch such as a four in fifteen ratio results, while utilizing the same structural members. This capability is extremely important for northern structures with heavy snow load requirements.

An integral part to my system is a multi-use principal structural member which is utilized as exterior supports for open web rigid frame members, commonly known as trusses. The truss designs are interchangeable anywhere in the modular concept resulting in larger open span capabilities.

Typical bay lengths are twelve, fifteen, eighteen and twenty-one feet using four inch members and corresponding spacer plates. Building load and wind requirements vary in different regions with each region having multiple load conditions for commercial, residential and agricultural. Various bay lengths may be utilized to meet required loadings resulting in the most affordable application. Increased bay lengths result in reduced cost per square foot. Proportionally larger members and spacer plates can be employed for larger scale applications providing greater open spans and wall heights. Conversely, proportionally smaller scale members and spacer plates can be used to construct smaller structures from storage buildings to play houses to model or toy building sets.

This building system lends itself to mass production and distribution. Due to its numerous configurations and applications utilizing so few components, this pre-engineered prefabricated modular building system can be carried as an "in-stock" item by dealers, distributors and/or franchisees.

Therefore, a primary object of the present invention is to provide a light weight pre-engineered prefabricated modular building system.

Specifically, an object of the present invention is to provide a modular building system which allows construction of a building employing easily inventoried interchangeable spacer plates, structural members, and components.

An object of the present invention is to provide a light weight pre-engineered prefabricated modular building system capable of producing multiple gable wall sizes and configurations.

An object of the present invention is to provide a modular building system which provides a choice of roof designs including double pitch, cantilever, and single pitch.

A related object of the present invention is to provide a modular building system.

Another object of the present invention is to provide a modular building system in which building length is independent of the gable, wall and roof design.

Another object of my modular building system is to provide a simple to erect building which is conducive to use by a do-it-yourself builder.

Another object of the present invention is to provide an affordable modular building system.

Another object of the present invention is to provide a modular building having a long life span.

An object of the present invention is to provide a modular building system capable of being mass produced and mass distributed.

Another object of the present invention is to provide a modular building system capable of being configured in a shallow pitch or a steep pitch roof configuration utilizing the same structural members by selective use of spacers.

A related object of my modular building system is to provide the capacity to deal with various load conditions.

Specifically, an object of my modular building system is to provide the capacity to deal with heavy snow loads.

An object of the present invention is to provide a modular building system which utilizes an interchangeable principal structural member as truss cords.

A related object of my modular building system is to provide a truss design which is interchangeable and configurable for use anywhere in the building.

An object of my modular building system is to provide a truss configuration wherein all truss legs and roof trusses are interchangeable.

An object of the present invention is to provide a modular building system in which increasing the dimensions and thickness of spacers and structural members will increase load capabilities.

An object of the present invention is to provide a modular building system which is faster and easier to erect making it more conducive to use by contractors.

An additional object of the present invention is to provide a modular building system is to provide a building system conducive to use by minimum skilled laborers.

An object of the present invention is to provide a modular building system well suited for use for disaster relief situations requiring immediate delivery.

An object of the present invention is to provide a modular building system that may be easily disassembled and reassembled with no loss of materials.

A related object of my building system is to provide a building system well suited for use by the oil and gas industry in covering field compressors in compliance with storm water run off laws.

An object of the present invention is to provide a modular building system which is capable of multiple uses, specifically in commercial, residential and agricultural applications.

An object of the present invention is to provide a modular building system which is conducive to use by the armed services.

An object of the present invention is to provide a modular building system which is capable of building cities in third world countries.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
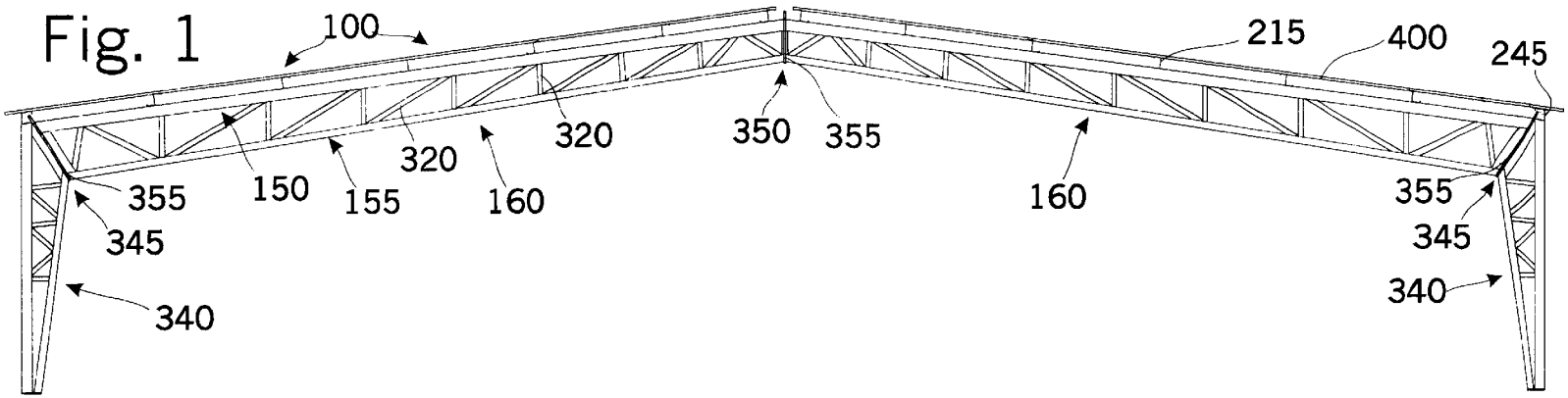
FIG. 1 is a front elevational view of a double pitch, open bay, shallow pitched roof three bay width building frame constructed using my light weight pre-engineered prefabricated modular building system employing a truss.

With reference now to the accompanying drawings, the preferred embodiment of my lightweight pre-engineered prefabricated modular building system 100 is broadly designated by the reference numeral 100.

Application of the structural members and selectively usable spacer plates making up the system 100 results in a rhythm that is embodied by a modular building system 100 producing numerous building sizes using relatively few components. The present building system 100 is simple, strong and cost effective.

The width of bays in the present system 100 is based directly on the structural member size. Based on engineering data by the Light Gage Structural Institute established in 1990and the Light Gage Structural Steel Framing System Design Handbook, four inch columns are best suited to fifteen foot bays; six inch columns are best suited to twenty-one foot bays; and eight inch columns are best suited to twenty-seven foot bays; all with various gable widths.

Generally, reference is made to the four inch system throughout this disclosure as illustrative of the system 100. The four inch system consist of principle structural members of various lengths, two sizes and two alternative configurations; and a set of three spacers, selectively used at the peak and hauches of the building frames.

Figure 9:
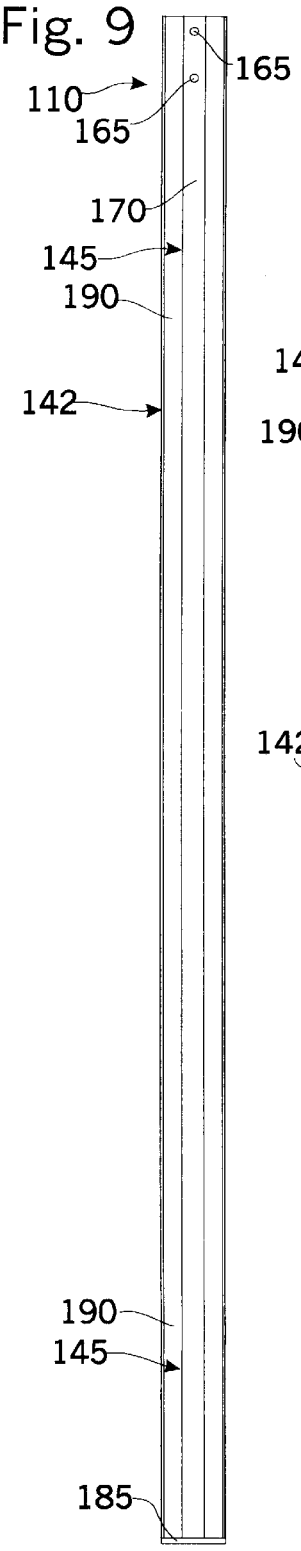
FIG. 9 is a front elevational view of the principal structural member employed by my modular building system, with a base plate.
Figure 10:
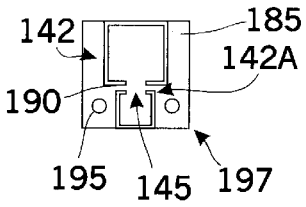
FIG. 10 is a fragmented top plan view of a base plate.
Figure 10A:
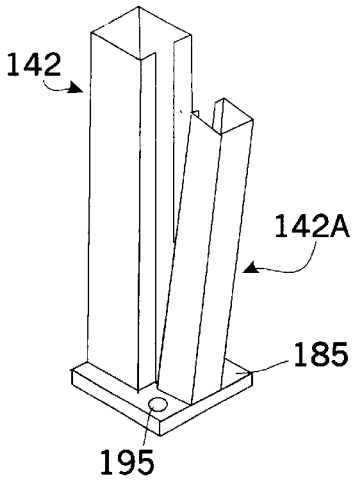
FIG. 10A is a fragmented perspective view of the base of a truss leg.
Figure 11:
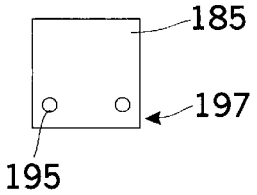
FIG. 11 is a bottom plan view of the base plate.
Figure 12:
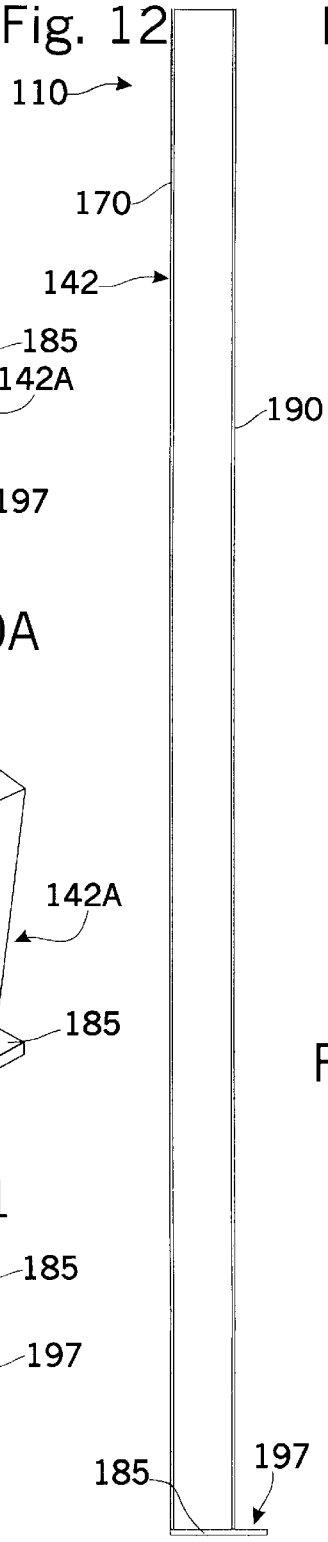
FIG. 12 is a side elevational view of the principal structural member.

The Trusses 160 are constructed from a principal structural member 142. The member 142 is generally tubular. The illustrated embodiment of the principal structural member 142 employs a longitudinal notch 145. Therefore, the illustrated structural member 142 has a generally closed "C" shaped cross-section. FIGS. 9 and 10. The dimensions and thickness of the principal structural member 142 is dependent on load requirements, length of spans, or building height. Generally speaking, the principal structural member 142 is either rectangular or square. For practical concerns it will generally be square. The width of the notch 145, for notched members 142 is determined by load requirements, lengths of spans and/or height.

This principal structural member 142 is utilized as both top and bottom cords 150 and 155 for trusses 160 (FIG. 7) in the present system 100. The notch 145 allows access to attach girts 162 and framed openings. A base plate 185 is welded to the bottom of a member 142 to secure truss legs 340 to the building floor or foundation. The base plate 185 protrudes past the side 190 defining the notch 145 (FIG. 10). Two holes 195 are defined in the protruding portion 197 of the base plate to receive anchor bolts. Preferably, members 142 are pre-marked at appropriate girt 162 and framed opening heights or girt brackets are pre-welded at the appropriate heights. The width of the notch 145 of a notched principal structural member 142 is determined by load requirements, lengths of spans and/or height, as well as size and attachment method of intermediate web members.

Figure 7:
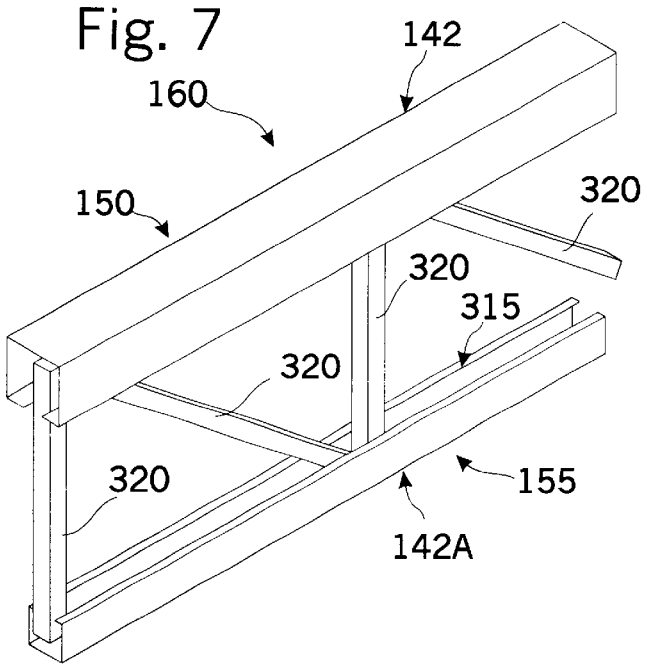
FIG. 7 is a fragmentary isometric view of a truss employing two sizes of principal structural members and tubular web members.

Two sizes of the principal structural member 142 are employed as components in trusses 160. FIG. 7. The top cord 150 of the truss 160 is a larger member 142 while, the bottom cord 155 of the truss 160 is a smaller member 142A. In the illustrated embodiment, the notch 145 of the members 142 and 142A, forming the cords 150 and 155, receive square tubular web members 320. Both size members 142 and 142A have the same size notch 145. The tubular web members 320 are welded in place on both sides of the notch 145. Spacing and thickness of the web members 320 is dependent upon load requirements.

Figure 8:
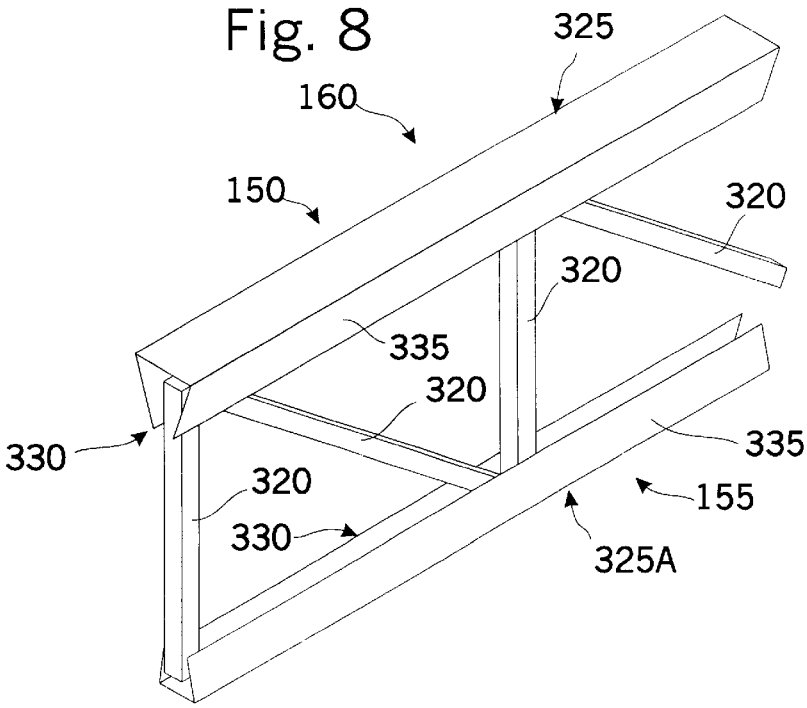
FIG. 8 is a fragmentary isometric view of a truss employing two sizes of alternative angular truss members and tubular web members.
Figure 13:
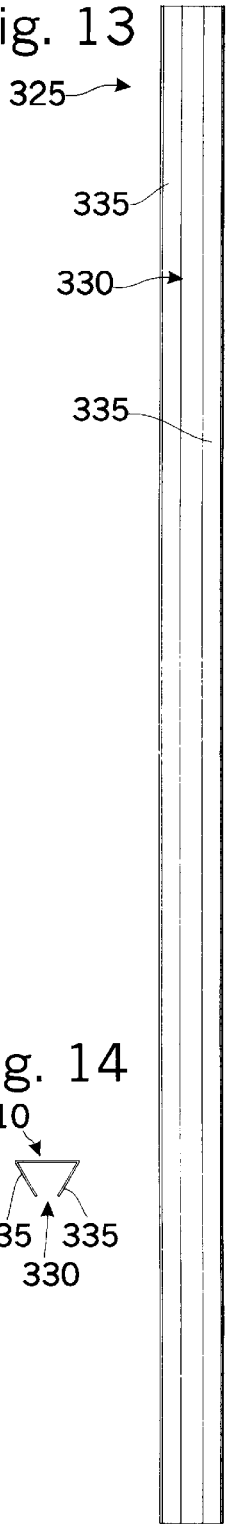
FIG. 13 is a front elevational view of an alternative angular structural member which can be employed in the trusses in my modular building system.
Figure 14:
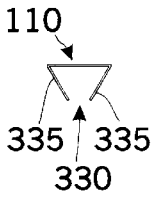
FIG. 14 is an end view of an alternative angular structural member.
Figure 15:
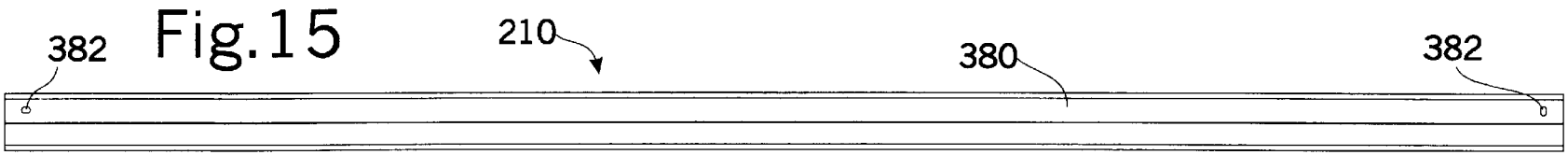
FIG. 15 is a top plan view of a purlin employed in the modular building system.
Figure 16:
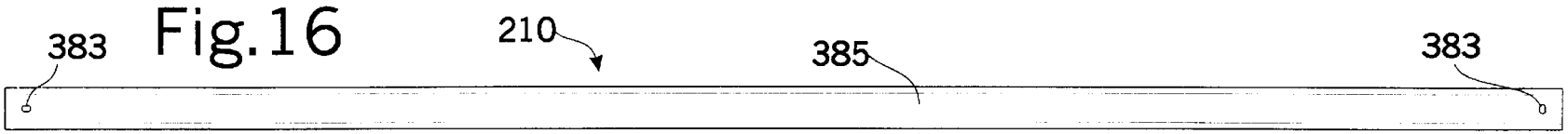
FIG. 16 is a side elevational view of a purlin.

Alternatively, an angular structural member 325 is employed to create trusses 160. FIG. 8. The angular structural member 325 is a three sided elongated member 325 having a generally truncated triangular cross-section. FIGS. 13 and 14. The opening 330 defined by the two legs 335 of the angular structural member receives tubular truss web members 320. Two size angular structural members 325 and 325A are utilized in trusses 160. The larger size angular structural members 325 is used as the top cord 150 of the truss 160 and the smaller size angular structural members 325A is used as the bottom cord 155. Both size angular structural members 325 and 325A have the same width openings 330.

Figure 2:
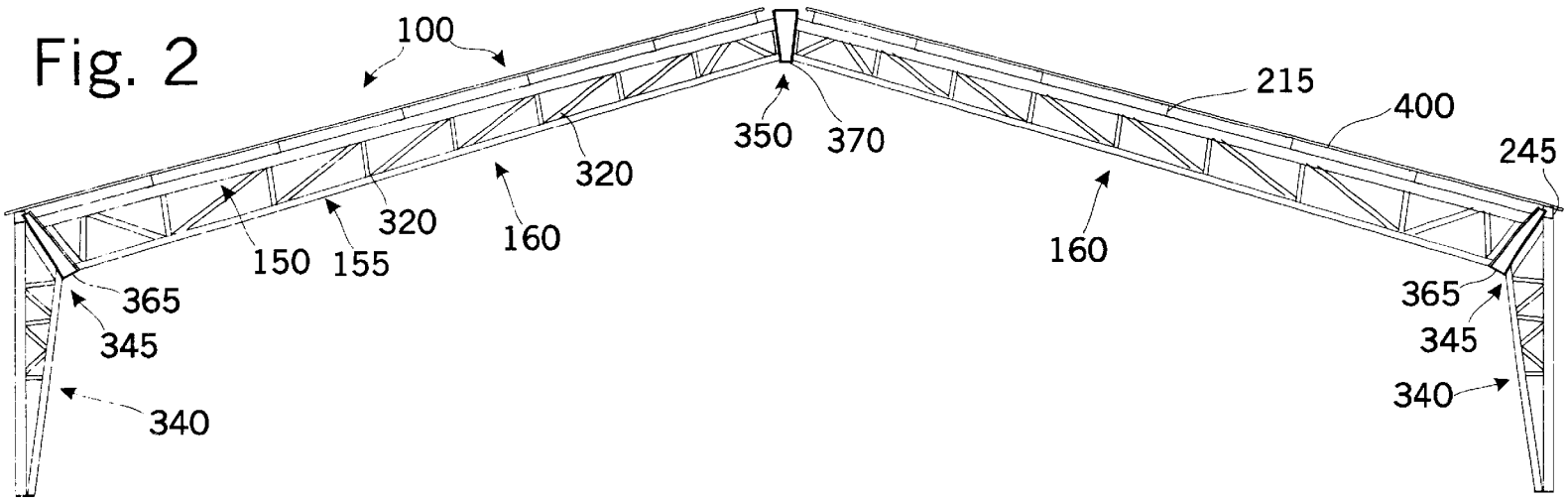
FIG. 2 is a front elevational view of a double pitch, open bay, steep pitched roof three bay width building frame constructed using my light weight pre-engineered prefabricated modular building system employing a truss with steep pitch peak and eave spacer plates.
Figure 4:
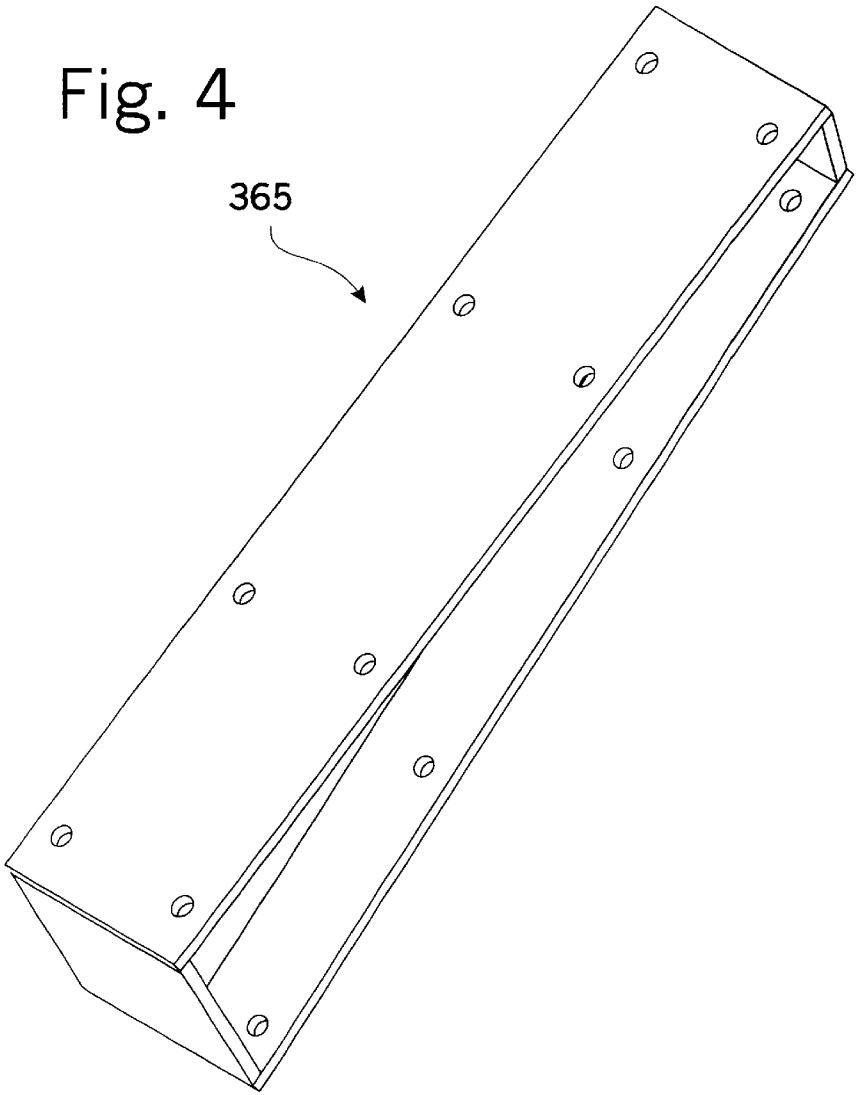
FIG. 4 is an isometric view of a steep pitch eave truss spacer plate.
Figure 3:
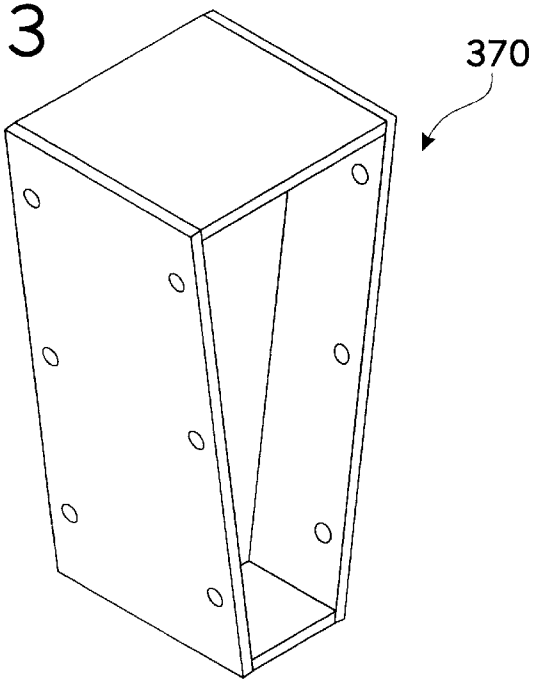
FIG. 3 is an isometric view of a steep pitch peak truss spacer plate used in three bay building frames.
Figure 5:
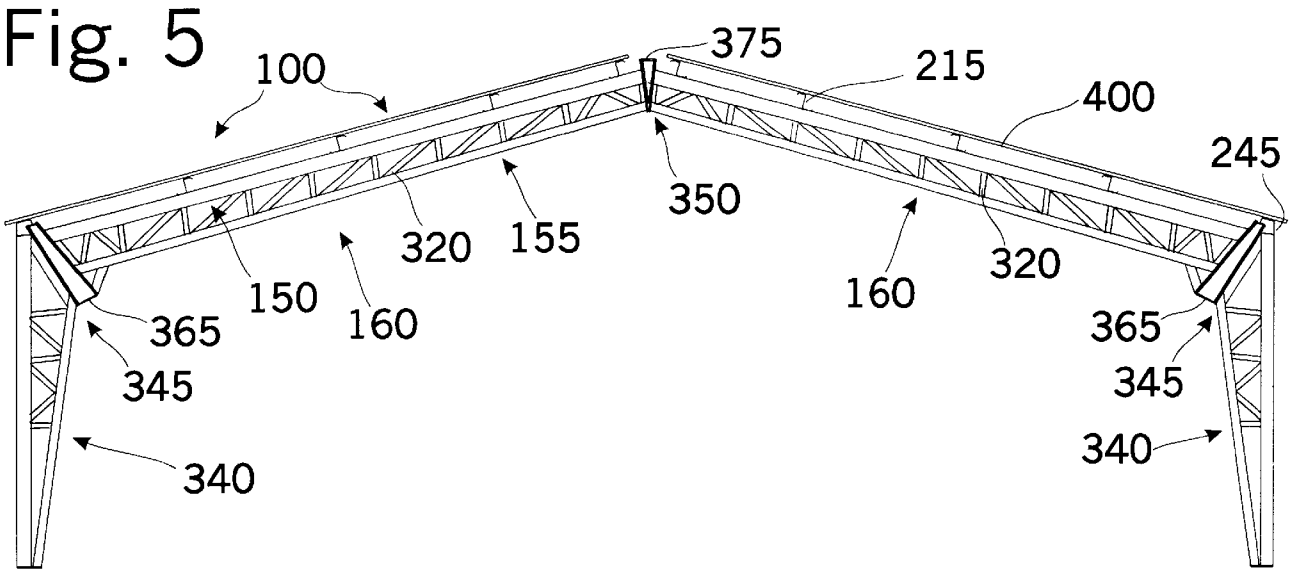
FIG. 5 is a front elevational view of a double pitch, open bay, steep pitched roof two bay width building frame constructed using my light weight pre-engineered prefabricated modular building system employing a truss with steep pitch truss peak and eave spacer plates.
Figure 6:
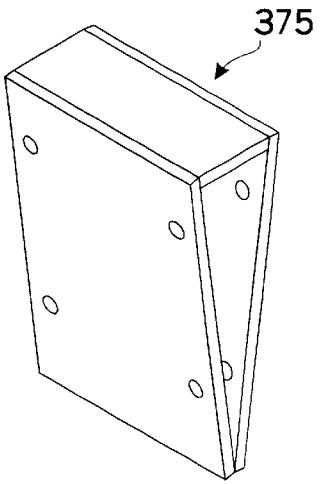
FIG. 6 is an isometric view of a steep pitch peak truss spacer plate used in two bay building frames.

The system's modular trusses 160 and truss legs 340 are interchangeable in height and width, as well as pitch. The ends of the trusses 160 and 340 are joined at the haunch 345 and peak 350 by end and top plates 355. Truss pitch spacers 365, 370 and 375 allow the same trusses 160 and truss legs 340 to be used in steep pitch roof buildings. FIGS. 2 and 5. In a steep pitch building, a truss peak spacer 370 or 375, FIGS. 3 and 6 is used at the peak 350 to join trusses 160, and a truss eave spacer 365 (FIG. 4) is used to join trusses 160 to truss legs 340. This allows a dealer or distributor to stock multiple width buildings in shallow and steep pitches, in different heights by stocking trusses 160, truss legs 340 and three pitch spacer plates 365, 370 and 375.

Figure 17:
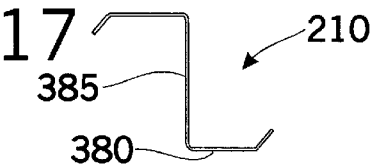
FIG. 17 is a greatly enlarged end view of a purlin.

The purlins 210 employed in the present system 100 have a generally "Z" shaped cross-section. FIGS. 3 and 6. Thickness of the purlin members 215 (FIG. 17) is determined by regional conditions and length of members. The lower horizontal leg 380 of the purlins 210 define elongated slots 382 for attachment to trusses 160. Purlins 210 may be bolted directly to with trusses 160 or purlin clips may be used to attach purlins 210 to truss legs 340 using self drilling screws or welded in place. The purlins 210 define elongated slots 383 on the vertical portion 385 of the member near the ends to adjoin purlins 210. The length of the purlins 210 is dependent on lap configuration. In other words, the overlap of the purlins 210 may be increased to increase roof load capabilities. The holes 383 are punched in the vertical leg 385 of the purlin 210 are appropriately spaced to secure laps. Purlins 210 may be attached in several ways.

Figure 20:
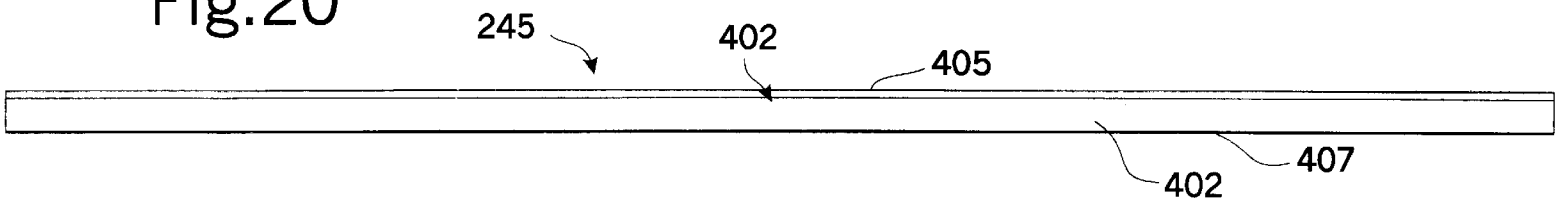
FIG. 20 is an inside elevational view of an eave-peak strut employed in the modular building system.
Figure 21:
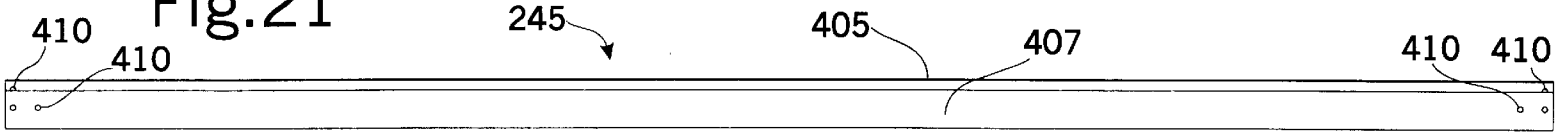
FIG. 21 is a bottom plan view of an eave-peak strut.
Figure 22:
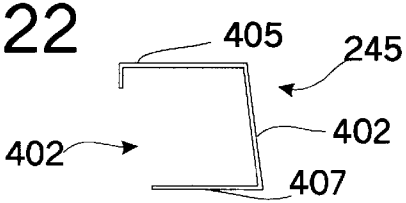
FIG. 22 is a greatly enlarged end view of an eave peak strut.

An eave-peak strut 245 (FIGS. 20–22) is employed at the eave of the building and at the peak 350 for attachment of exterior sheathing 400 or skin. The eave-peak strut 245, illustrated in FIGS. 20 through 22, attaches to the eave of all building configurations, with the strut's open face 402 facing inward, creating the upper outside portion of the building frame. Side wall skin 400 is attached to the side leg 403 of the eave-peak strut 245 using self tapping drill screws. The upper portion 405 of the eave-peak strut is utilized for attaching exterior roof sheets 400 at the eave 390.

Figure 18:
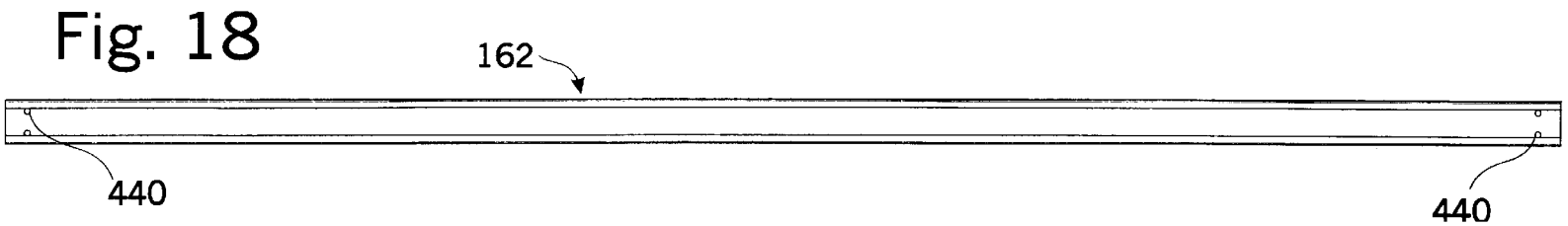
FIG. 18 is an inside elevational view of a girt employed in the modular building system.
Figure 19:
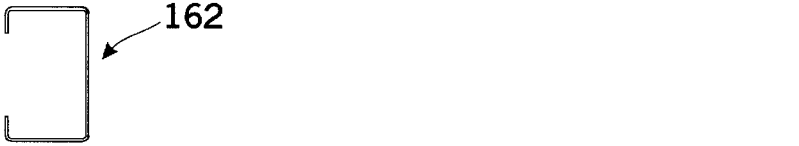
FIG. 19 is a greatly enlarged end view of a girt.
Figure 23:
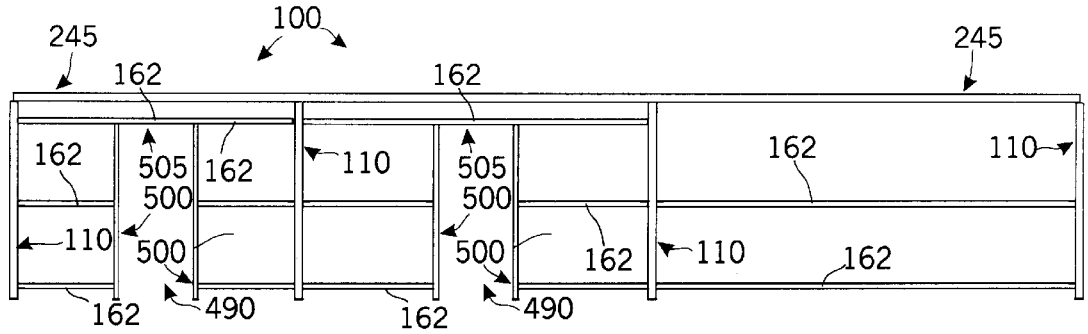
FIG. 23 is a partially fragmented side elevational view of an end wall of building frame constructed using my building system, with various bay lengths, illustrating the deployment of girts and door openings; and, FIG. 24 is a partially fragmented side elevational view of a another an end wall of a building frame constructed using my building system, with various bay lengths, illustrating the deployment of girts and door openings.
Figure 24:
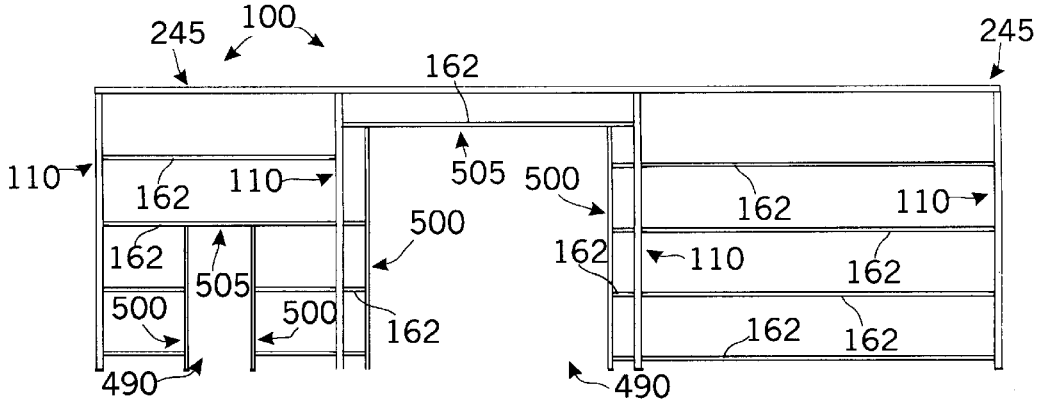

Horizontally disposed girts 162 are utilized for gable wall and side wall skin 400 attachment. See FIGS. 23 through 24. The girts 162 are generally rectangular, tubular elongated members having a "C" shaped cross-section (FIGS. 18 and 19) and are secured to the truss legs 340. The base of the wall skins 400 are attached to either a base angle anchored to the floor of the building or to a base girt 162 spaced above the concrete slab, attached to a truss leg 340 or framed opening with clips. Generally, at least two additional spaced apart girts 162 are utilized in each bay. The girts 162 define holes 440 on each end for securing the girt in place.

In the four inch rhythm there are four bay lengths: twelve feet, fifteen feet, eighteen feet and twenty-one feet. Utilization of these bay lengths create three separate load conditions. The shorter the bay, the greater the roof load capabilities.

The present purlin 210, strut 245, and girt 162 system allows a wide range of building lengths. These modular bay length configurations allow dealers or distributors to stock few components for a vast array of building configurations.

Alternative X-bracing, comprised of stainless steel cables with turn buckles or "I" bolts, can be utilized in the present modular building system 100, with appropriate bracing at the end walls, side walls and roof. Flat steel straps can be utilized for X-bracing in bays containing overhead door or walk door openings 490. These straps are attached to main frame truss legs 340 and framed openings 485 and 490 using self tapping drill screws.

All framed openings 490 in this system 100 utilize "C" tubing as side, vertical framing 500, with girts 162 utilized as door headers 505. Framing 500 forming the side of an opening have pre-punched base plates for anchor bolt attachment and pre-welded header plates for attachment to headers 505 using self tapping drill screws. Thusly, overhead doors are centered in bays, walk doors may be placed in the center of bays or to either side. See FIGS. 23 and 24. Window framed openings 510 utilize "C" members as window side frames 515 and installed girts 162 as headers 520 and sills 522. This allows for window 510 placement at the builder's discretion.

Exterior sheathing 400 for my lightweight pre-engineered prefabricated modular building system 100 may be of any metal or aluminum panel configuration or wood products and siding. Preferably skin 400 and trim is attached with self taping drill screws using neoprene washers. Vinyl backed fiberglass insulation can be anchored between the frame members the outer skin.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense. For example, the use of various sizes of members is anticipated as well as the use of numerous building materials including but not limited to steel, wood, aluminum and composites.

What is claimed is:

1. A lightweight pre-engineered prefabricated modular building system comprising:

a plurality of principal structural members, said structural members comprising a generally tubular body;

a plurality of peripheral truss leg columns, each of said truss leg columns comprising:

an outside cord comprising a principal structural member;

an inside cord comprising a smaller principal structural member;

a plurality of tubular truss web members extending from said inside cord to said outside cord;

a base plate extending generally perpendicularly from a lower extent of said body, generally horizontally, said base plate defining at least one anchor orifice; and, an angularly disposed top truss plate extending between an upper extent of said outside cord and an upper extent of said inside cord;

a pair of roof trusses extending between two of said truss leg columns, each of said roof trusses comprising:

a top cord comprising a principal structural member;

a bottom cord spaced apart from said top cord, said bottom cord comprising a smaller principal structural member;

a plurality of tubular truss web members extending from said top cord to said bottom cord;

an angularly disposed inside truss plate extending between an inside extent of said top cord and an inside extent of said bottom cord; and, an angularly disposed outside truss plate extending between an outside extent of said top cord and an outside extent of said bottom cord; and, wherein, the inside truss plates of each roof truss in a pair of roof trusses are secured together and the outside truss plate of each roof truss is secured to one of said top truss plates of said truss leg columns.

2. The lightweight pre-engineered prefabricated modular building system as defined in claim 1 wherein:

a steep pitch truss peak spacer plate is selectively disposed between the inside truss plates of each roof truss in a pair of roof trusses for steep pitch buildings;

a steep pitch truss eave spacer plate is selectively disposed between the outside truss plate of each roof truss and said top truss plate on the upper extent of each of said truss leg columns, for steep pitch buildings; and, said spacer plates comprise spaced apart angularly disposed plates and webbing extending between said plates.

3. The lightweight pre-engineered prefabricated modular building system as defined in claim 2 wherein said principal structural members have a generally "C" shaped cross-section, said body of said principal structural members comprising a longitudinal notch, and said tubular truss web members are received by said notch defined in each of said principal structural member cords.

4. The lightweight pre-engineered prefabricated modular building system as defined in claim 3 further comprising an eave peak strut, said eave peak strut comprising an elongated generally tubular body having an angled side with an opposite open face, an upper portion defining a lip extending into said open face and a lower portion, said cave peak strut mounted to said upper extent of said outside cord with said angled side of said cave peak strut facing outward.

5. The lightweight pre-engineered prefabricated modular building system as defined in claim 4 further comprising elongated purlins having a generally "Z" shaped cross section, said purlins extending between and generally perpendicular to said top cords to secure roof sheathing to a building in said building system.

6. The lightweight pre-engineered prefabricated modular building system as defined in claim 5 further comprising generally "C" shaped girts extending generally perpendicularly between said outside cords to secure side wall sheathing to a building in said building system.

7. A lightweight pre-engineered prefabricated modular building system for a shallow pitch roof building comprising:

a plurality of principal structural members, said structural members comprising a generally tubular body;

a plurality of peripheral truss leg columns, each of said truss leg columns comprising:

an outside cord comprising a principal structural member;

an inside cord comprising a smaller principal structural member;

a plurality of tubular truss web members extending from said outside cord to said inside cord;

a base plate extending generally perpendicularly from a lower extent of said body, generally horizontally, said base plate defining at least one anchor orifice; and an angularly disposed top truss plate extending between an upper extent of said outside cord and an upper extent of said inside cord; and, a pair of roof trusses extending between two of said truss leg columns, each of said roof trusses comprising:

a top cord comprising a principal structural member;

a bottom cord spaced apart from said top cord, said bottom cord comprising a smaller principal structural member;

a plurality of tubular truss web members extending from said top cord to said bottom cord;

an angularly disposed inside truss plate extending between an inside extent of said top cord and an inside extent of said bottom cord, said inside truss plates of each of said roof trusses in said pair of roof trusses joined together to form a peak; and, an angularly disposed outside truss plate extending between an outside extent of said top cord and an outside extent of said bottom cord, said out side truss plate secured to one of said top truss plates of one of said truss leg columns.

8. The lightweight pre-engineered prefabricated modular building system as defined in claim 7 wherein said principal structural members have a generally "C" shaped cross-section, said body of said principal structural members comprising a longitudinal notch, and said tubular truss web members are received by said notch defined in each of said principal structural member cords.

9. The lightweight pre-engineered prefabricated modular building system as defined in claim 8 further comprising an eave peak strut, said eave peak strut comprising an elongated generally tubular body having an angled side with an opposite open face, an upper portion defining a lip extending into said open face and a lower portion, said eave peak strut mounted to said upper extent of said outside cord with said angled side of said eave peak strut facing outward.

10. The lightweight pre-engineered prefabricated modular building system as defined in claim 9 further comprising elongated purlins having a generally "Z" shaped cross section, said purlins extending between and generally perpendicular to said top cords to secure roof sheathing to a building in said building system.

11. The lightweight pre-engineered prefabricated modular building system as defined in claim 10 further comprising generally "C" shaped girts extending generally perpendicularly between said outside cords to secure side wall sheathing to a building in said building system.

12. A lightweight pre-engineered prefabricated modular building system for a steep pitch roof building comprising:

a plurality of principal structural members, said structural members comprising a generally tubular body;

a plurality of steep pitch spacer plates comprising spaced apart angularly disposed plates and webbing extending between said spacer plates;

a plurality of peripheral truss leg columns, each of said truss leg columns comprising:

an outside cord comprising a principal structural member;

an inside cord comprising smaller principal structural member;

a plurality of tubular truss web members extending from said top cord to said bottom cord;

a base plate extending generally perpendicularly from a lower extent of said body, generally horizontally, said base plate defining at least one anchor orifice; and an angularly disposed top truss plate extending between an upper extent of said outside cord and an upper extent of said inside cord;

a pair of roof trusses extending between two of said truss leg columns, each of said roof trusses comprising:

a top cord comprising a principal structural member;

a bottom cord spaced apart from said top cord, said bottom cord comprising a smaller principal structural member;

a plurality of tubular truss web members extending from said top cord to said bottom cord;

an angularly disposed inside truss plate extending between an inside extent of said top cord and an inside extent of said bottom cord; and, an angularly disposed outside truss plate extending between an outside extent of said top cord and an outside extent of said bottom cord;

a steep pitch truss peak spacer plate disposed between the inside truss plates of each roof truss in each of said pairs of roof trusses; and a steep pitch truss eave spacer plate disposed between the outside truss plate of each roof truss and said top truss plates.

13. The lightweight pre-engineered prefabricated modular building system as defined in claim 12 wherein said principal structural members have a generally "C" shaped cross-section, said body of said principal structural members comprising a longitudinal notch, and said tubular truss web members are received by said notch defined in each of said principal structural member cords.

14. The lightweight pre-engineered prefabricated modular building system as defined in claim 13 further comprising an eave peak strut, said eave peak strut comprising an elongated generally tubular body having an angled side with an opposite open face, an upper portion defining a lip extending into said open face and a lower portion, said eave peak strut mounted to said upper extent of said outside cord with said angled side of said eave peak strut facing outward.

15. The lightweight pre-engineered prefabricated modular building system as defined in claim 14 further comprising elongated purlins having a generally "Z" shaped cross section, said purlins extending between and generally perpendicular to said top cords to secure roof sheathing to a building in said building system.

16. The lightweight pre-engineered prefabricated modular building system as defined in claim 15 further comprising generally "C" shaped girts extending generally perpendicularly between said outside cords to secure side wall sheathing to a building in said building system.

17. The lightweight pre-engineered prefabricated modular building system as defined in claim 1 wherein said principal structural members have a generally "C" shaped cross-section, said body of said principal structural members comprising a longitudinal notch, and said tubular truss web members are received by said notch defined in each of said principal structural member cords.

* * * * *